US005575642A

United States Patent [19]

Willis et al.

[11] Patent Number: 5,575,642

[45] Date of Patent: Nov. 19, 1996

[54] GRATE PLATE

[75] Inventors: David J. Willis, St. Louis; Keith C. Houghton, Festus, both of Mo.

[73] Assignee: The Carondelet Corporation, Pevely, Mo.

[21] Appl. No.: 565,970

[22] Filed: Dec. 1, 1995

[51] Int. Cl.[6] ..... F27D 15/02

[52] U.S. Cl. ..... 432/78; 110/291; 110/299; 126/163 R

[58] Field of Search ..... 432/77, 78; 126/163 R; 110/298, 299, 300, 291, 283

[56] References Cited

U.S. PATENT DOCUMENTS

| | | | |
|---|---|---|---|
| 3,413,938 | 12/1968 | Dvirka | 110/38 |
| 3,892,044 | 7/1975 | Kayatz | 34/20 |
| 4,170,183 | 10/1979 | Cross | 110/268 |
| 4,473,013 | 9/1984 | John et al. | 110/235 |
| 4,510,873 | 4/1985 | Shigaki | 110/289 |
| 4,512,266 | 4/1985 | Shigaki | 110/204 |
| 4,515,147 | 5/1985 | Van Grouw et al. | 126/163 |
| 4,563,959 | 1/1986 | Fujiwara | 110/281 |
| 4,592,724 | 6/1986 | Durr et al. | 432/78 |
| 4,600,098 | 7/1986 | Orren | 198/773 |
| 4,624,636 | 11/1986 | Willis | 432/78 |
| 4,629,421 | 12/1986 | Kreisberg et al. | 432/77 |
| 4,732,561 | 3/1988 | Eiring et al. | 432/78 |
| 4,762,489 | 8/1988 | Schmits et al. | 432/77 |
| 4,870,913 | 10/1989 | Schneider | 110/299 |
| 5,129,820 | 7/1992 | Kupper et al. | 432/77 |
| 5,149,266 | 9/1992 | Heinemann et al. | 432/77 |
| 5,174,747 | 12/1992 | Massaro, Jr. et al. | 126/163 R |
| 5,197,397 | 3/1993 | Yamagishi et al. | 110/281 |
| 5,209,169 | 5/1993 | Basic, Sr. | 110/235 |
| 5,245,983 | 9/1993 | Krieger | 126/163 |
| 5,282,741 | 2/1994 | Massaro et al. | 432/77 |
| 5,322,434 | 6/1994 | Milewski et al. | 432/78 |
| 5,433,157 | 7/1995 | Dittmann et al. | 110/291 |

FOREIGN PATENT DOCUMENTS

| | | |
|---|---|---|
| 2219915 | 12/1973 | France . |
| 2021482 | 11/1971 | Germany . |
| 2345734A1 | 3/1975 | Germany . |
| 2901065A1 | 7/1980 | Germany . |
| 3634660A1 | 4/1988 | Germany . |
| 0337383A1 | 4/1989 | Germany . |
| 0477467A2 | 5/1991 | Germany . |
| 0473880A1 | 5/1991 | Germany . |
| 0480123A1 | 5/1991 | Germany . |

OTHER PUBLICATIONS

*Rock Products;* Apr. 1990 Issue; p. 114; Advertising Index and Advertisement for "Clinker Cooler optimization using the PETERS–Muldenplate System".

"Mulden Grate Plate System For Clinker Coolers" by Claudius Peters (admitted prior art).

*Primary Examiner*—Noah P. Kamen

*Attorney, Agent, or Firm*—Senniger, Powers, Leavitt & Roedel

[57] ABSTRACT

A grate plate for use in cooling heated material has a plurality of spaced apart walls including a front wall, side walls, a top wall and a bottom wall. A plenum is located generally within the walls for receiving a cooling fluid within the grate plate. The top wall has a trough for receiving heated material. An opening in the grate plate is located rearwardly of the front wall for receiving the cooling fluid into the plenum. The plenum is shaped for delivering air from the opening to the front wall of the grate plate and then rearwardly adjacent to a side wall of the trough. A port in the trough permits exhaust of the cooling fluid from the exhaust duct into the trough for cooling the heated material on the grate plate.

17 Claims, 5 Drawing Sheets

GRATE PLATE

BACKGROUND OF THE INVENTION

This invention relates generally to particulate material coolers, and more particularly to grate plates used in cooling hot particulate material.

There are presently particulate material coolers, such as those used to cool hot cement clinker after it is discharged from a kiln. These systems commonly have tiered rows of grate plates descending from a kiln outlet to a cooled material outlet. The grate plates in each row lie closely adjacent to one another to form a substantially continuous working surface for the heated material. Each row of grate plates is attached to a respective support structure. In such an arrangement, the rear portion of each grate plate is overlapped by a grate plate of the row above, and the forward portion of each grate plate overlaps the rear portion of a grate plate in the row below. It is also known to oscillate some of the rows of grate plates back and forth to encourage the forward flow of heated material through the cooler. As hot particulate material exits the kiln and enters the cooler, gravity and oscillation of some rows of the grate plates causes the material to generally move forward, descending from one tier to the next while the material is cooled. In some coolers, cooling is effected, in part, by a stream of cooling air flowing from the support structure up through the bottom of the grate plates.

Grate plates constructed to permit cooling air to flow through them from beneath may have openings in an exposed upper surface of the grate plate opening directly to the underside of the grate plate. Flow of air to any particular row of grate plates cannot be controlled with this type of grate plate. Other grate plates are constructed to permit the flow of air to each row of grate plates to be independently controlled. A controlled flow grate plate is generally box-shaped, and defines an internal plenum opening to the underside of the plate only at the bottom rear of the grate plate. Cooling air must pass into the plenum through the rear opening and thence forward through longitudinally extending ducts in the grate plate to the openings to the upper surface of the grate plate. The grate plate is attached to a channel beam having an open top over which the rear opening of the grate plate is disposed. Air flow through the channel beam and out the grate plates mounted thereon can be controlled independently of other channel beams mounting rows of grate plates in the cooler.

A problem associated with prior controlled flow grate plates is the relatively short life span due to thermal effects. The exposed front wall of each grate plate is subject to relatively high temperatures from the heated material continually flowing over the forward portion of the grate plate. In cooling systems which have oscillating rows of grate plates, the front walls of the moving grate plates are subject to high temperatures when pushing the heated material forward.

It is known to provide a duct in the plenum extending laterally along the front wall of the grate plate. Any cooling air not forced out of the openings in the longitudinally extending ducts reaches the front wall of the grate plate and provides cooling to the front wall. Other grate plates, having no openings to their upper surfaces, channel cooling air directly to the front wall, and forwardly out through openings in the front wall. Drawbacks associated with these approaches are that either much of the coolest air is released through the openings in the longitudinally extending ducts before it reaches the front wall, or the air is released through the front wall without cooling the heated material on the top surface of the grate plate.

SUMMARY OF THE INVENTION

Among the several objects and features of this invention may be noted the provision of an improved grate plate which has a longer useful life; the provision of a grate plate that is more resistant to thermal effects; the provision of a grate plate which makes efficient use of the coolest air; the provision of such a grate plate which guides the coolest air first to the hottest parts of the plate; and the provision of such a grate plate which uses air to cool selected locations of the grate plate and to cool particulate material on the grate plate.

In general, a grate plate of this invention comprises a plurality of spaced apart walls including a front wall, side walls, a top wall and a bottom wall. A plenum within the walls receives a cooling fluid within the grate plate. There is an opening in the grate plate located rearward of the front wall for receiving the cooling fluid into the plenum. The plenum is shaped for delivering air from the opening first to the front wall of the grate plate and then rearwardly. A port in the trough permits exhaust of the cooling fluid directed rearwardly of the front wall in the plenum through the top wall for cooling the heated material on the grate plate.

Other objects and features will be in part apparent and in part pointed out hereinafter.

BRIEF DESCRIPTION OF THE DRAWINGS

Corresponding parts are indicated by corresponding reference numerals throughout the several views of the drawings.

DETAILED DESCRIPTION OF THE PREFERRED EMBODIMENTS

Figure 1:
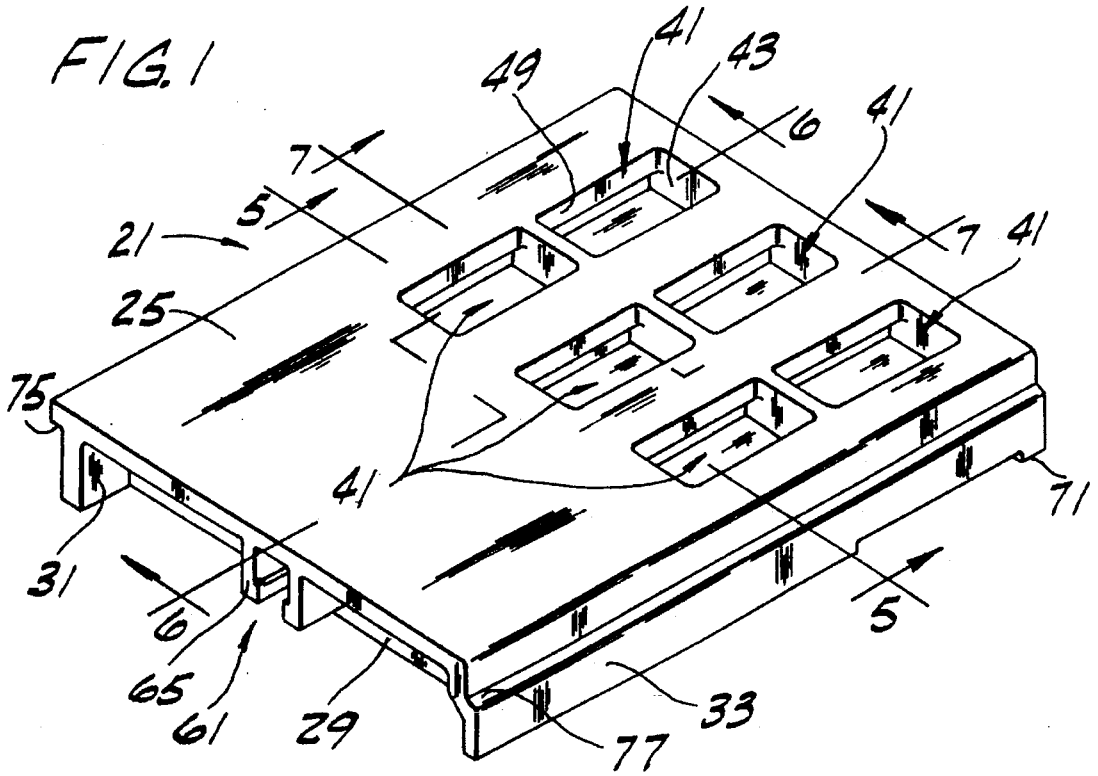
FIG. 1 is a perspective view of a grate plate as seen from the top, rear and right side of the grate plate.
Figure 8:
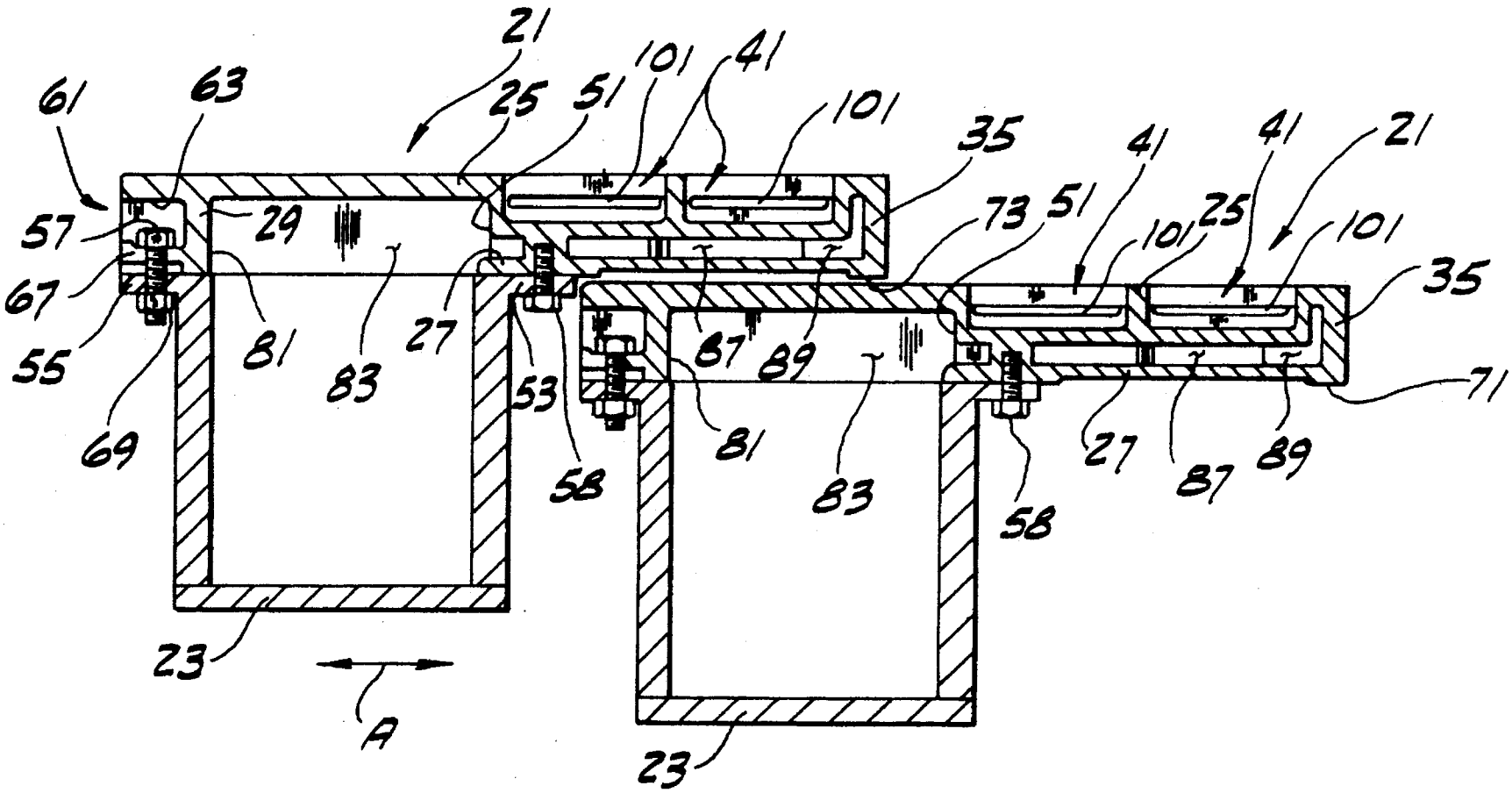
FIG. 8 is a fragmentary, schematic longitudinal section of a cooler illustrating grate plates from two adjacent rows.

Now referring to the drawings, specifically FIGS. 1 and 8, the reference numeral 21 refers generally to a grate plate used in a cooler for cooling hot particulate material, such as hot cement clinker discharged from a kiln (not shown). The cooler includes grate plates 21 mounted on support structure (e.g. channel beams 23) in tiered rows, with the uppermost row at the entrance to the cooler and the lowermost row at the cooler exit. Only two rows of grate plates are illustrated in FIG. 8, it being understood that the cooler actually has a substantial additional number of rows, each row overlapping the next lower row as shown in FIG. 8. Each row contains grate plates 21 arranged in side-by-side relationship to one another. The channel beams 23 and grate plates 21 are arranged such that the forward portion of each grate plate on that channel beam overlaps the rear portion of the grate plate lying in the row immediately below it. Hot particulate material enters the cooler at the uppermost row of grate plates. Some of the channel beams 23 and attached rows of grate plates 21 may oscillate back and forth (as indicated by arrow A in FIG. 8 for the upper channel beam and row) to urge the hot particulate material to move forward through the cooler. Cooling air flowing from the grate plates 21 cools the heated material as the material flows across each grate plate. As the heated material descends toward the cooler exit, it is continually cooled by the air flow.

The grate plate 21 is preferably formed as a single piece using a polystyrene based casting method. However, it is to be understood that a grate plate could be formed from multiple pieces joined together and still fall within the scope of the present invention. Each grate plate 21 has a top wall 25, a bottom wall 27, a rear wall 29, side walls 31,33 and a front wall 35. The top wall 25 includes an exposed forward portion, and a rear portion which is overlapped by the bottom wall 27 of the grate plate one row above. The forward portion of the top wall 25 includes troughs (generally indicated at 41) into which some of the heated particulate material is received and retained. The troughs 41 shown in FIG. 1 extend longitudinally along the forward portion of the grate plate 21. Each trough 41 has a front end 43, a rear end 45, a bottom 47 and sides 49. The material retained in each trough 41 eventually fills the trough, and becomes the surface contacted by hot particulate material flowing across the grate plate 21. Using the material as a contact surface, rather than the metal surface of the grate plate 21, reduces wear due to abrasion by the flowing particulate material and insulates the metal surface of the plate to a degree from the thermal effects of the hot particulate material, thus increasing the life span of the grate plate.

The rear portion of the bottom wall 27 of the grate plate 21 has an opening 81. The top of the channel beam 23 on which the grate plate 21 is mounted is open, and each grate plate is mounted on the channel beam such that the opening 81 in the bottom wall 27 is disposed directly over the open top in the beam. The width of the open top of the channel beam 23 is substantially the same as the length of the opening 81 in the bottom wall 27. A flange 53 extends forward from the top of the forward wall of the channel beam 23, and another flange 55 extends rearward from the top of the rear wall of the channel beam. The grate plate 21 is attached to the channel beam 23 by a bolt 57 located behind the rear wall 29 of the grate plate, and by screw fasteners 58 threaded into holes 59 located in the bottom wall 27 of the grate plate 21, forward of the partition wall 51. The screw fasteners 58 are received through a hole in the forward extending flange 53 and into the threaded holes 59 in the bottom wall 27. A bolt housing 61 on the outer surface of the rear wall 29 of the grate plate is centered between the side walls 31,33 of the grate plate 21. The top 63 of the bolt housing 61 is defined by the top wall 25 of the grate plate 21. The rear 65 of the bolt housing 61 is open, and the bottom 67 of the bolt housing is shaped to provide a contact surface for the bolt head. The bolt 57 is inserted into the bolt housing 61 such that the bolt head seats against the bottom 67 of the bolt housing and the bolt passes through a hole in the rearward extending flange 55. A nut 69 is threaded onto the bolt 57 to secure the grate plate 21 to the channel beam 23. Cooling air pumped in a controlled fashion through the channel beam 23 enters the grate plate 21 through the opening 81 overlying the open top of the channel beam. Although the grate plate 21 of the preferred embodiment is of the controlled flow type, it is to be understood that the flow of cooling air externally of the grate plate need not be controlled to fall within the scope of the present invention.

Figure 6:
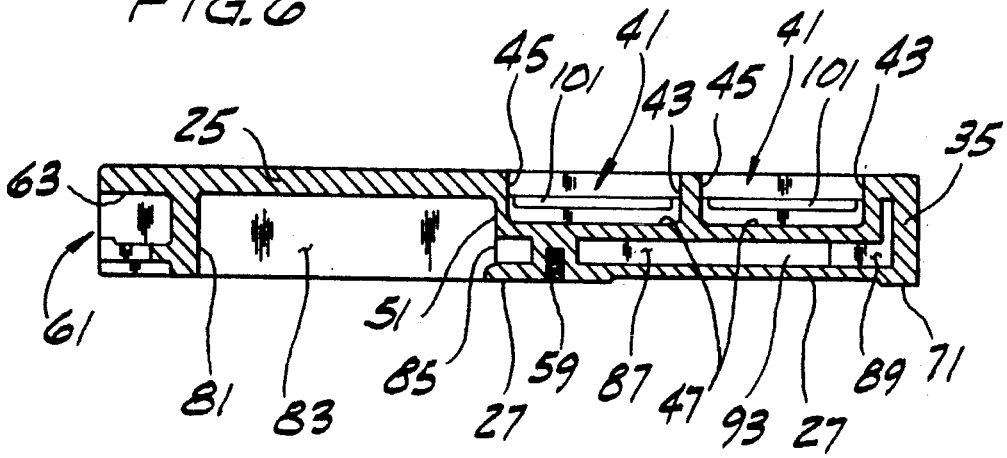
FIG. 6 is a section taken along the line 6—6 of FIG. 1.

As best seen in FIGS. 6 and 8, the grate plate 21 has a foot 71 at the bottom of the front wall 35. The outer surface of the bottom wall 27 extending aft of the foot 71 and back to approximately the threaded holes 59 where the grate plate 21 is mounted on the channel beam 23, is slightly recessed above the foot. When overlapping a grate plate below, there is preferably a small gap 73, approximately ⅛ to ¼ inch, between the foot 71 and the top wall 25 of the lower grate plate.

The side walls 31,33 of the grate plate 21 are shaped to allow for overlapping between adjacent grate plates in a row. An upper portion of one side wall 31 projects laterally outward from a lower portion of the wall and defines a lip 75. The opposite side wall 33 has a lower portion projecting laterally outward relative to an upper portion of the side wall such that the lower portion of the side wall forms a ledge 77. Although not shown, it is readily understood that adjacent grate plates in a row are arranged such that the lip 75 on the side wall 31 of one grate plate 21 overlaps and rests on the ledge 77 of the side wall 33 of an adjacent grate plate. Overlapping in this manner permits adjacent plates to be in contact while leaving space for thermal expansion, which reduces the amount of particulate material falling between the grate plates.

Figure 2:
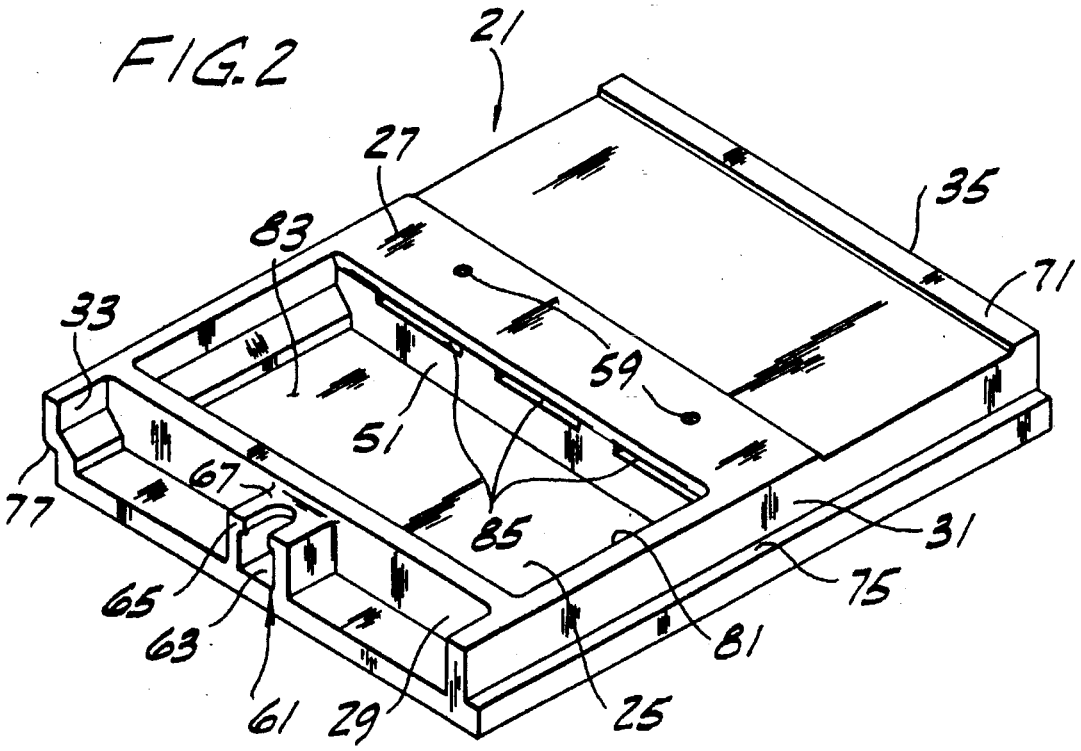
FIG. 2 is a perspective view of the grate plate as seen from the bottom, rear and left side of the grate plate.
Figure 3:
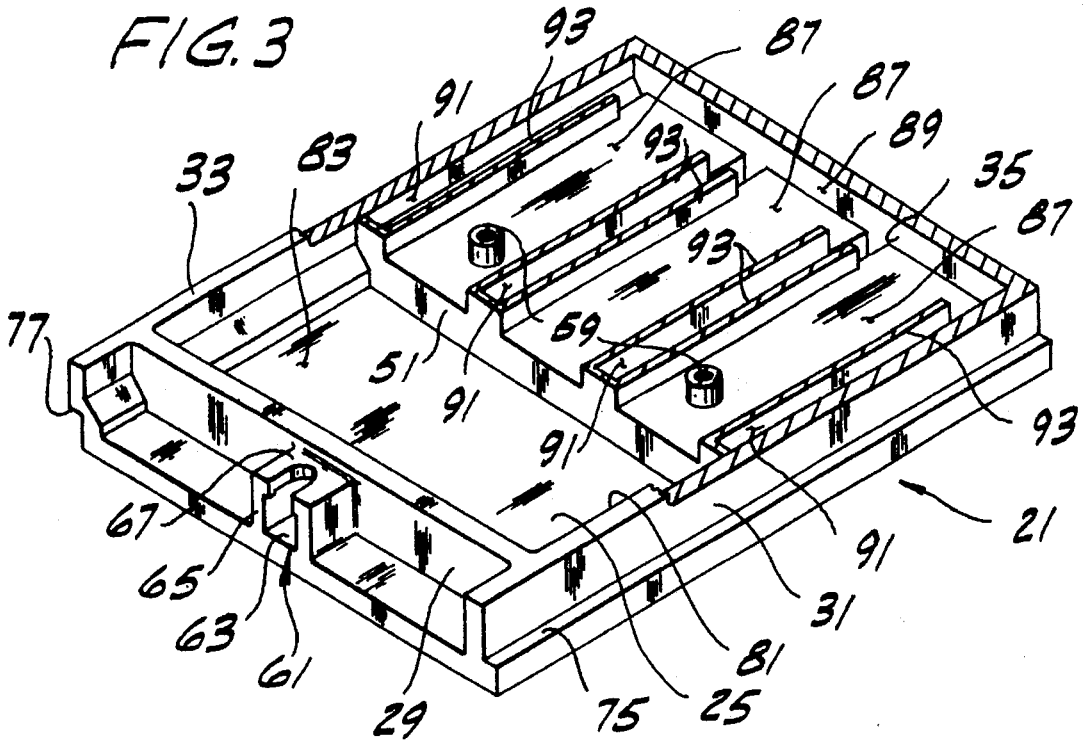
FIG. 3 is a perspective view similar to FIG. 2, but with a bottom wall removed to show internal construction.
Figure 4:
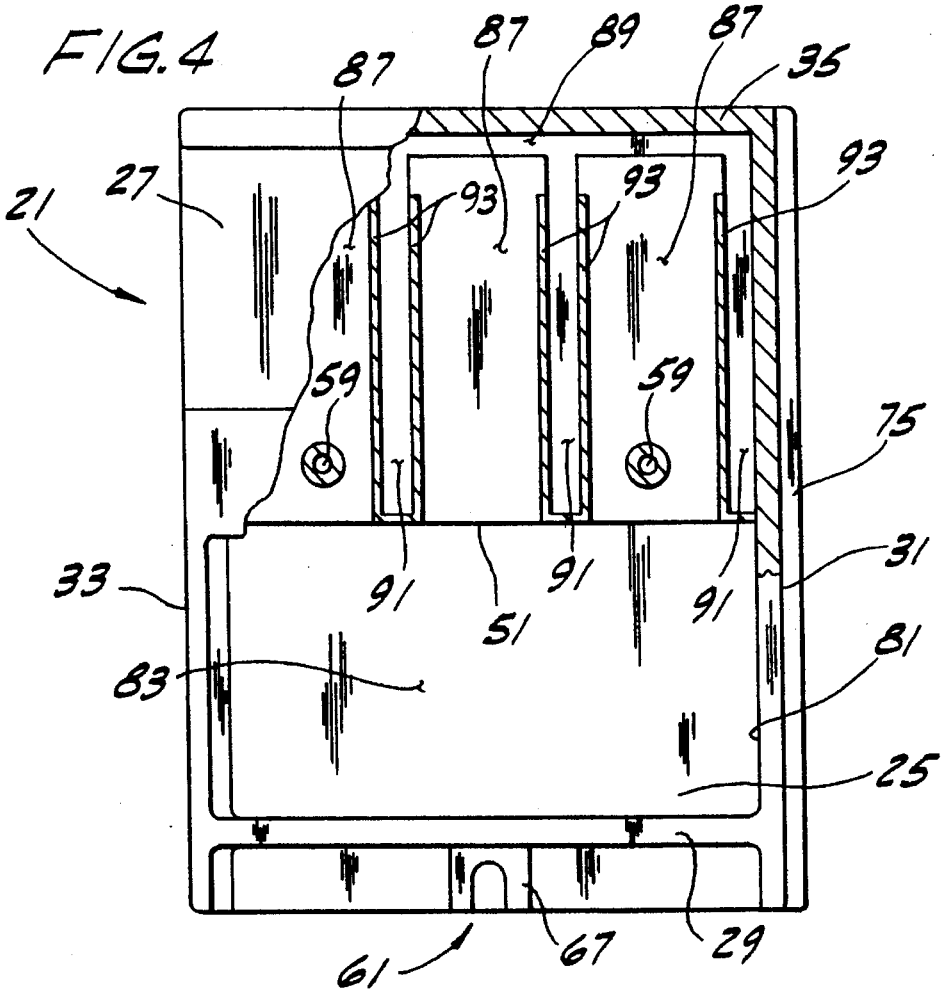
FIG. 4 is a bottom plan view of the grate plate with the bottom wall partially broken away.
Figure 5:
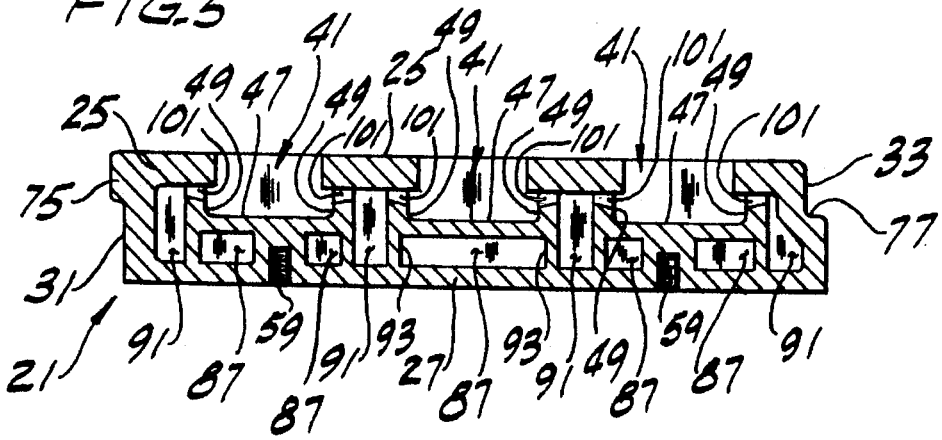
FIG. 5 is a section taken in the plane including line 5—5 of FIG. 1.

A plenum within the walls of the grate plate includes an entry chamber 83, air intake ducts 87, a transfer duct 89 and exhaust ducts 91. The entry chamber 83 is located above the opening 81 in the bottom wall 27 and is defined by the rear wall 29, rear portions of the side walls 31,33 and the partition wall 51. In the preferred embodiment shown in FIG. 2, there are three air intake openings 85 in the partition wall 51. Cooling air received through the opening 81 to the entry chamber 83 passes through the intake openings 85 in the partition wall 51 into the intake ducts 87. The intake ducts 87 extend forwardly under the troughs 41 from the entry chamber 83 in the bottom wall 27 toward the front wall 35. In the preferred embodiment, the intake ducts 87 are defined by the bottom wall 27 of the grate plate 21, the bottoms 47 of respective pairs of the troughs 41 and side wall extensions 93 extending downwardly from the sides 49 of the troughs to the bottom wall 27. The bottom wall 27 of the grate plate 21 defines the bottom of the intake ducts 87 and the bottoms 47 of the troughs 41 define the tops of the intake ducts.

The intake ducts 87 all open into the transfer duct 89, which extends laterally along the front wall 35 of the grate plate 21 between the side walls 31,33 of the grate plate. The transfer duct 89 is defined by the front wall 35 of the grate plate 21, the side walls 31,33 of the grate plate, the front ends 43 of the troughs next to the front wall 35, and the bottom wall 27 of the grate plate. Cooling air fed into the transfer duct 89 from the intake ducts 87 is distributed within the transfer duct over the front wall 35 of the grate plate 21 to remove heat from the front wall.

In the preferred embodiment, the two central exhaust ducts 91 are defined by the top wall 25 of the grate plate 21, the bottom wall 27 of the grate plate, the sides 49 of the troughs and the side extensions 93. The laterally outer exhaust ducts 91 are defined in part by respective side walls 31,33 of the grate plate 21. The laterally outer exhaust ducts 91 are further defined by respective sides 49 of the laterally outer troughs 41 and side extensions 93, and by the top and bottom walls 25,27 of the grate plate 21. The end of each exhaust duct 91 closest to the front wall 35 is in fluid communication with the transfer duct 89 such that cooling air within the transfer duct may pass into the exhaust ducts 91. The other end of each exhaust duct 91 is closed by the partition wall 51.

Figure 7:
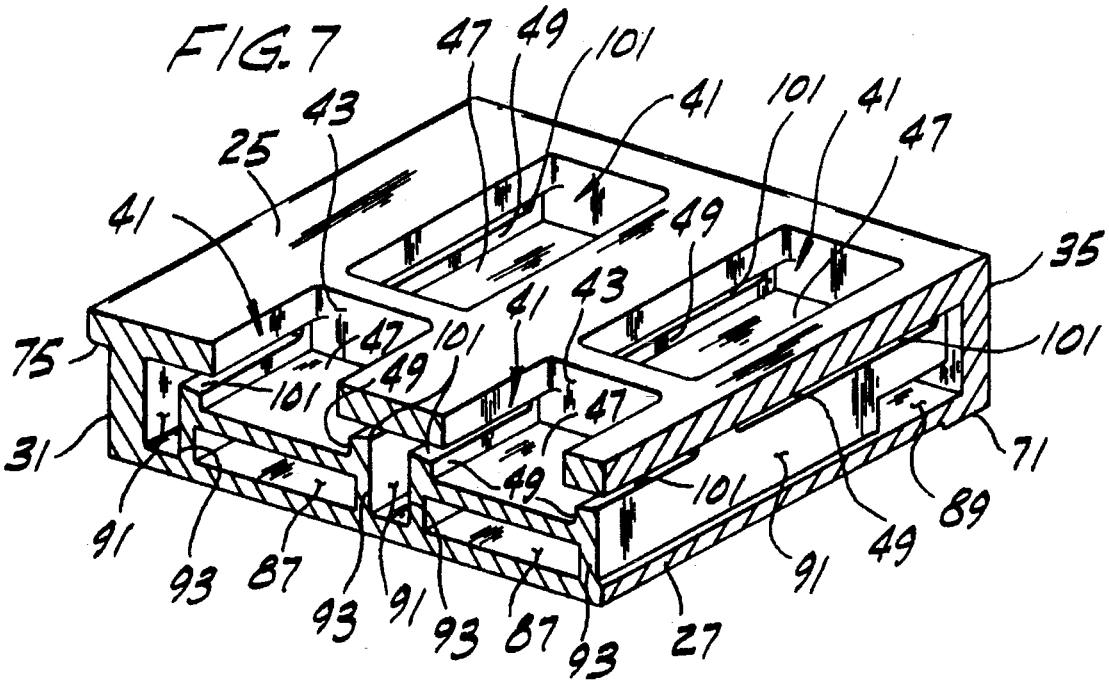
FIG. 7 is a perspective section taken along line 7—7 of FIG. 1.

As shown in FIG. 7, slots 101 extend through the sides 49 of the troughs 41 between the troughs and the exhaust ducts 91. These slots 101 provide the only fluid communication between the plenum within the grate plate 21 and the hot particulate material flowing along the top wall 35 of the grate plate. In the embodiment shown, the slots 101 extend along the length of each side 49 of the troughs 41. Cooling air flowing through the exhaust ducts 91 is directed through the slots 101 and into the troughs 41 filled with hot particulate material. All cooling air that enters the plenum of the grate plate 21 is directed through the slots 101 and into the troughs 41. The lower edges of the slots 101 are sloped downward from the exhaust duct 91 to the trough 41. Air flowing through the slots 101 is thus directed downward into the trough 41. Sloping the lower edge of the slot 101 downward into the trough 41 reduces the potential for particulate material falling into the slot and blocking the exhaust of cooling air. Air directed through the slots 101 forces the particulate material away from the slots. As the hot particulate material is received and retained within each trough 41, the force of the cooling air directed through the slots 101 maintains open paths leading to the upper surface of the retained material so that the cool air still passes through the top wall 25 of the grate plate 21 after the trough is filled.

In operation, the grate plates 21 are part of a cooler to cool heated particulate material as it is discharged from a kiln or the like (not shown). As the heated material enters the cooler, it falls onto one of the upper rows of grate plates. The heated material flows forward through the cooler, descending onto each row of grate plates. The material flow may be encouraged by oscillating one or more rows of grate plates in a back and forth motion. As the heated material moves forward across the grate plates, some of it is received and retained in the troughs 41 in the top wall 35 of the grate plates 21.

Cooling air forced through the channel beam 23 passes into the entry chamber 83 through the opening 81 in the bottom wall 27 of each grate plate 21 on the channel beam. The cooling air is then directed through the intake openings 85 in the partition wall 51, and into the air intake ducts 87. The cooling air leaving the intake ducts 87 passes into the transfer duct 89, and removes heat from the front wall 35 of the grate plate, which is typically the hottest part of the plate. The cooling air is then directed rearwardly through the exhaust ducts 91. Finally, the air passes through the slots 101 leading from the exhaust ducts 91 to the troughs 41, where the cooling air flows directly over the heated particulate material to cool the material. By directing the coolest air first through the intake ducts 87 and transfer duct 89, a more efficient use of the coolest air is made in cooling the front wall 35 of the grate plate 21 before directing the cooling air into the trough 41 to cool the heated particulate material.

Figure 9:
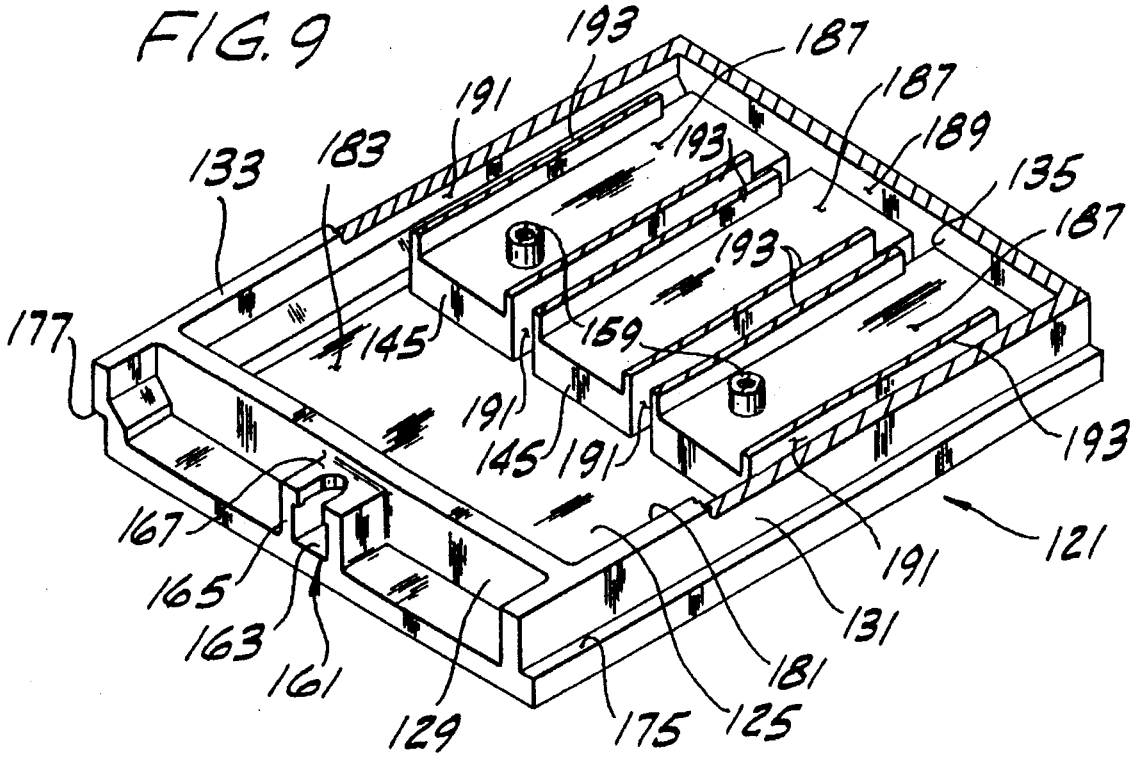
FIG. 9 is a bottom, fragmentary perspective view similar to FIG. 3 but showing a grate plate of a second embodiment.

A second and most preferred embodiment of the grate plate shown in FIG. 9 is designated generally at 121. Corresponding parts of the grate plate 121 of the second embodiment will be indicated by the same reference numerals used for the grate plate 21 of the first embodiment with the addition of the prefix "1". The grate plate 121 is substantially the same as the grate plate 21 except that the partition wall 51 of the first embodiment has been removed. Therefore, some air in the entry chamber 183 may directly enter the exhaust ducts 191 and pass out of the plenum through the slots 1101. It is to be understood that instead of removing the wall 51, only a partial wall (not shown) could be placed at the rear ends of the exhaust ducts 191 for bleeding a controlled amount of air from the entry chamber 183 directly into the exhaust ducts 191.

A portion of the air entering the entry chamber 183 still passes first forwardly in the intake ducts 187 to the transfer duct 189 where it cools the front wall 135. The air then passes from the transfer duct rearwardly into the exhaust ducts 191 and out the slots 1101. Thus it may be seen that with the plate 121 of the second embodiment, some of the coolest air passes directly to the exhaust ducts 191 and out the slots 1101 for cooling the hot particulate material, and some of the coolest air is directed first to the front wall 135 before exiting the plate 121.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A grate plate for use in cooling heated material, the grate plate comprising:

a plurality of spaced apart walls including a front wall, side walls, a top wall and a bottom wall, a plenum located generally within the walls for receiving a cooling fluid within the grate plate;

an opening in the grate plate located rearwardly of the front wall for receiving the cooling fluid into the plenum;

the plenum being shaped for delivering at least some cooling fluid from the opening first to the front wall of the grate plate and then rearwardly;

a port disposed for permitting exhaust of the cooling fluid directed rearwardly of the front wall in the plenum through the top wall for cooling the heated material on the grate plate.

2. A grate plate as set forth in claim 1 further comprising a plurality of ports disposed for permitting exhaust of the cooling fluid directed rearwardly of the front wall, the ports being the only exit for the cooling fluid from the plenum.

3. A grate plate as set forth in claim 1 wherein the plenum comprises an intake duct defined within the grate plate, the intake duct being in fluid communication with the opening and extending generally from the opening toward the front wall of the grate plate, a transfer duct defined at least in part by the front wall of the grate plate and extending along the front wall generally transversely of the plate, the transfer duct being in fluid communication with the intake duct for receiving the cooling fluid to cool the front wall of the grate plate, and an exhaust duct defined within the grate plate and in fluid communication with the transfer duct, the exhaust duct extending rearwardly from the front wall.

4. A grate plate as set forth in claim 3 wherein the top wall of the grate plate has a trough therein, the trough having a bottom, front end, rear end and opposing sides.

5. A grate plate as set forth in claim 4 wherein the intake duct extends under the trough and is partially defined by the bottom of the trough.

6. A grate plate as set forth in claim 5 wherein the exhaust duct extends rearwardly along a side of the trough and is partially defined by the side of the trough, and wherein the port is located in the side of the trough.

7. A grate plate as set forth in claim 6 wherein the exhaust duct is partially defined by one of the side walls of the grate plate.

8. A grate plate as set forth in claim 7 wherein the transfer duct is further partially defined by the front end of the trough.

9. A grate plate as set forth in claim 8 further comprising a plurality of ports disposed for permitting exhaust of the cooling fluid directed rearwardly of the front wall in the exhaust duct, the ports being the only exit for the cooling fluid from the plenum.

10. A grate plate as set forth in claim 9 wherein the opening is located rearward of the trough and opens downwardly.

11. A grate plate as set forth in claim 4 wherein the intake duct constitutes a first intake duct, and wherein the grate plate further comprises a second intake duct defined within the grate plate, the second intake duct being in fluid communication with the opening and extending generally from the opening toward the front wall of the grate plate.

12. A grate plate as set forth in claim 11 wherein the exhaust duct constitutes a first exhaust duct, the grate plate further comprising a second exhaust duct defined within the grate plate and in fluid communication with the transfer duct, the second exhaust duct extending rearwardly from the front wall and adjacent to the trough on one of the sides thereof opposite the first exhaust duct, each of the first and second exhaust ducts being partially defined by respective sides of the trough, and wherein the grate plate further comprises at least one port for each exhaust duct, the ports being disposed for permitting exhaust of the cooling fluid directed rearwardly in the exhaust ducts into the trough, the ports being the only exit for the cooling fluid from the plenum.

13. A grate plate as set forth in claim 4 further comprising a plurality of troughs located in generally side-by-side relationship, each trough having a bottom, front end, rear end and sides.

14. A grate plate as set forth in claim 13 further comprising a plurality of intake ducts, each of the intake ducts extending under a respective one of the troughs and being partially defined by the bottom of the trough.

15. A grate plate as set forth in claim 14 further comprising a plurality of exhaust ducts defined within the grate plate and in fluid communication with the transfer duct, the exhaust ducts extending rearwardly from the front wall and adjacent to the troughs, each of the exhaust ducts being partially defined by a respective one of the sides of the troughs, and wherein the grate plate further comprises at least one port for each exhaust duct, the ports being disposed for permitting exhaust of the cooling fluid directed rearwardly in the exhaust ducts into the troughs, the ports being the only exit for the cooling fluid from the plenum.

16. A grate plate as set forth in claim 15 wherein two of the exhaust ducts are partially defined by respective ones of the side walls of the grate plate.

17. A grate plate as set forth in claim 16 wherein the opening is located rearward of the troughs and opens downwardly.

* * * * *